US012017826B2

(12) United States Patent
Inwood et al.

(10) Patent No.: US 12,017,826 B2
(45) Date of Patent: Jun. 25, 2024

(54) TAMPER-EVIDENT PAPERBOARD FOOD CONTAINER

(71) Applicant: Calumet Carton Company, South Holland, IL (US)

(72) Inventors: John Inwood, Mokena, IL (US); Gina Inwood, Frankfort, IL (US)

(73) Assignee: Calumet Carton Company, South Holland, IL (US)

( * ) Notice: Subject to any disclaimer, the term of this patent is extended or adjusted under 35 U.S.C. 154(b) by 0 days.

(21) Appl. No.: 16/996,819

(22) Filed: Aug. 18, 2020

(65) Prior Publication Data

US 2021/0053713 A1 Feb. 25, 2021

Related U.S. Application Data

(60) Provisional application No. 62/888,912, filed on Aug. 19, 2019.

(51) Int. Cl.
*B65D 5/06* (2006.01)
*B65D 5/02* (2006.01)

(52) U.S. Cl.
CPC ..... *B65D 5/062* (2013.01); *B65D 5/0227* (2013.01)

(58) Field of Classification Search
CPC ..... B65D 5/062; B65D 5/0227; B65D 5/06; B65D 5/0263; B65D 5/061; B65D 5/2076; B65D 5/241; B65D 5/28; B65D 5/067–068; B65D 5/541; B65D 5/5455
USPC ..... 229/136, 102, 132, 137, 141, 184
See application file for complete search history.

(56) References Cited

U.S. PATENT DOCUMENTS

| | | | | |
|---|---|---|---|---|
| 2,367,440 | A * | 1/1945 | Schieman | B65D 27/16 229/80 |
| 2,889,102 | A | 6/1959 | Wagaman | |
| 4,340,169 | A | 7/1982 | Webinger | |
| 4,750,612 | A | 6/1988 | Schuster | |
| 5,839,652 | A | 11/1998 | Ben-Haim | |
| 7,325,720 | B2 * | 2/2008 | Jeppsson | B65D 5/062 229/137 |
| 9,061,789 | B2 | 6/2015 | Lopez Masague | |
| 2001/0032872 | A1 * | 10/2001 | Guest | B65D 27/16 229/92.7 |

(Continued)

FOREIGN PATENT DOCUMENTS

| | | | | |
|---|---|---|---|---|
| EP | 2724953 | A1 * | 4/2014 | B65D 5/541 |
| WO | WO2020/109884 | | 6/2020 | |

*Primary Examiner* — Nathan J Newhouse
*Assistant Examiner* — Phillip D Schmidt
(74) *Attorney, Agent, or Firm* — Cook Alex Ltd.

(57) ABSTRACT

A paperboard food container incudes a receptacle with an opening, and a closure disposed across the opening. The closure includes two surfaces, one having a tamper-evident region of weakness. One of the surfaces has an edge with a length and a tab attached to the edge, the tab having a first position wherein the tab overlies a portion of the surface having a length substantially equal to the length of the edge and a second position wherein the tab is spaced from the surface. One of the tab and the portion of the surface has an adhesive disposed thereon, and the other of the tab and the portion has a release coating disposed thereon. With the tab in the first position, the adhesive cannot be joined to the other surface, but with the tab in the second position, the surfaces may be joined to seal the closure.

15 Claims, 2 Drawing Sheets

(56) References Cited

U.S. PATENT DOCUMENTS

| | | | | |
|---|---|---|---|---|
| 2003/0201315 | A1* | 10/2003 | Jamison | B65D 5/541 229/102 |
| 2004/0026490 | A1* | 2/2004 | Jeppson | B65D 5/062 229/137 |
| 2008/0023534 | A1* | 1/2008 | Huth | B65D 5/068 229/216 |
| 2013/0264380 | A1* | 10/2013 | Dolby | B65D 5/067 229/117.19 |
| 2016/0122069 | A1 | 5/2016 | Eisen et al. | |
| 2017/0225822 | A1* | 8/2017 | Cooper | B65D 5/42 |

* cited by examiner

TAMPER-EVIDENT PAPERBOARD FOOD CONTAINER

This application claims the benefit of U.S. Provisional Patent App. No. 62/888,912, filed Aug. 19, 2019, which application is hereby incorporated by reference herein.

BACKGROUND

This patent is directed to a paperboard food container, and, in particular, to a paperboard food container that provides a tamper-evident closure.

It is known to provide plastic containers for food products that include a tamper-evident closure. That is, the container is manufactured in such a way that that if the container's closure is opened, it is apparent. As such, the closure is not necessarily tamper-proof (i.e., the closure is resistant to all attempts to open the closure in an unauthorized manner), but the closure provides evidence that the closure has been sealed and then opened.

One known plastic container that provides a tamper-evident closure has the following structures and operates in the following manner. The container has a rim with a lid joined by a web that extends from one edge of the rim. The web has a tear strip formed by two lines of weakness, such that the web may be divided into two sections if the tear strip is removed. The lid is pivoted about the edge until the lid received in and engages the container, at which point the lid cannot be removed from the container unless the tear strip is removed.

Such a container is convenient and provides a tamper-evident closure, but plastic containers can cause issues relative to manufacture, storage and disposal. Consequently, there is a need for tamper-evident packaging that does not present the same commercial and environmental challenges as plastic containers. On the other hand, a substitute for such a tamper-evident package cannot represent significant disposal or waste issues of its own, nor must the structure or use of the substitute be more complicated, such that user adoption of the solution is jeopardized as a result.

SUMMARY

According to an aspect, a paperboard container incudes a paperboard receptacle and a paperboard closure. The paperboard receptacle encloses, in an assembled state, a three-dimensional space in which a food product may be disposed and has an opening through which the food product enters the space. The paperboard closure is disposed across the opening, and includes first and second surfaces, one of the first and second surfaces having a tamper-evident region of weakness that may be irreversibly split to open the closure. The first surface has an edge with a length and a tab attached to the edge, the tab having a first position wherein the tab overlies a portion of the first surface having a length substantially equal to the length of the edge and a second position wherein the tab is spaced from the first surface.

One of the tab and the portion of the first surface has an adhesive disposed thereon and the other of the tab and the portion of the first surface has a release coating disposed thereon. With the tab in the first position, the one of the tab and the portion of the first surface having the adhesive disposed thereon cannot be joined to the second surface to seal the closure. With the tab in the second position, the one of the tab and the portion of the first surface having the adhesive disposed thereon is joined to the second surface to seal the closure.

DETAILED DESCRIPTION OF VARIOUS EMBODIMENTS

A paperboard container according to the disclosed embodiments includes a paperboard receptacle and a paperboard closure. The receptacle encloses, in an assembled state, a three-dimensional space in which a food product may be disposed, and has an opening through which the food product enters the space. The closure is disposed across the opening and has a tamper-evident feature, such as a region of weakness that may be irreversibly split to open the closure.

In general terms, the closure includes first and second surfaces. The first surface has a tab with a first position wherein the tab overlies a portion of the first surface, and a second position wherein the tab is spaced from the first surface. One of the tab and the portion of the first surface has an adhesive disposed thereon, and the other of the tab and the portion of the first surface has a release coating disposed thereon.

With the tab in the first position, the one of the tab and the portion of the first surface having the adhesive disposed thereon cannot be joined to the second surface to seal the closure. With the tab in the second position, the one of the tab and the portion of the first surface having the adhesive disposed thereon is joined to the second surface to seal the closure.

It will be recognized that the paperboard container thus described may have many variants, relative to the shape and size of the receptacle, the nature of the adhesive and release coating, and the nature of the tamper-evident region of weakness. The following is a discussion of an exemplary embodiment of the container to further illustrate, but not limit, the features of the container.

Figure 1:
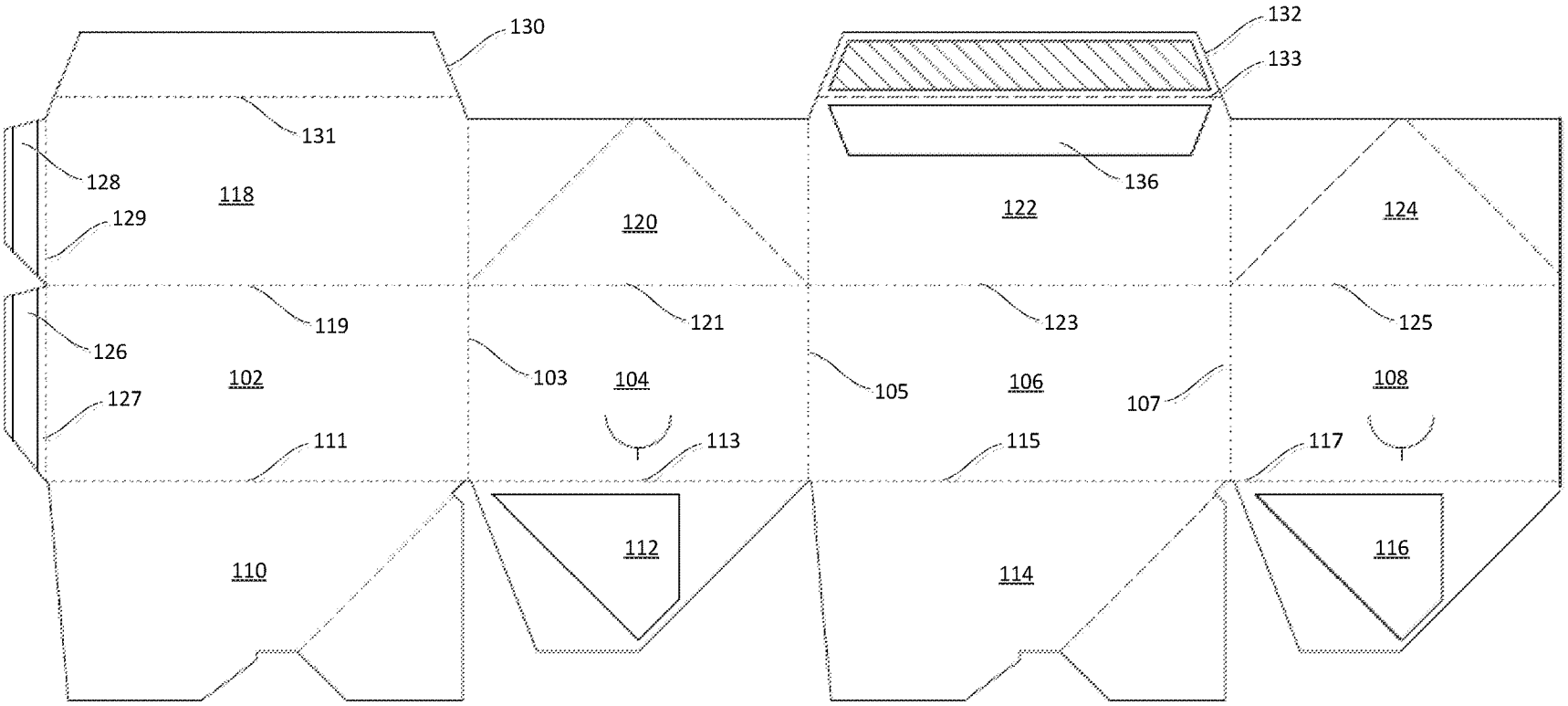
FIG. 1 is a plan view of a blank used to form a paperboard food container with a tamper-evident closure.

Referring first to FIG. 1, blank 100 that may be formed into a paperboard container is provided. The blank 100 has sections 102, 104, 106, 108 that are joined at fold lines 103, 105, 107, and that each define a side wall of the paperboard container, as assembled. The blank 100 also has sections 110, 112, 114, 116 that are each joined along fold lines 111, 113, 115, 117 to one of the sections 102, 104, 106, 108, and that may be joined together to define a floor of the paperboard container as assembled. Further, the blank 100 has sections 118, 120, 122, 124 that are each joined along fold lines 119, 121, 123, 125 to one of the sections 102, 104, 106, 108, and that define a closure for the paperboard container.

The blank 100 also includes tabs 126, 128 that are joined along fold lines 127, 129 to the sections 102, 118 and may be joined to sections 108, 124 so as to define two rectangular structures. The first structure (defined by sections 102, 104, 106, 108) along with the floor encloses, in an assembled state, a three-dimensional space in which a food product may be disposed. The first structure also defines an opening through which the food product enters the space. The second structure (defined by sections 118, 120, 122, 124) defines the closure disposed across the opening.

As such, the sections 118, 122 define first and second surfaces. It is not necessary that section 122 define the first surface and section 118 define the second surface in all embodiments. As illustrated, however, the section 122 defines the first surface and the section 118 defines the second surface. Each of the sections 118, 122 includes a tab 130, 132 joined to the section 118, 122 along an edge 131, 133, the structure and operation of which is discussed below.

Figure 2:
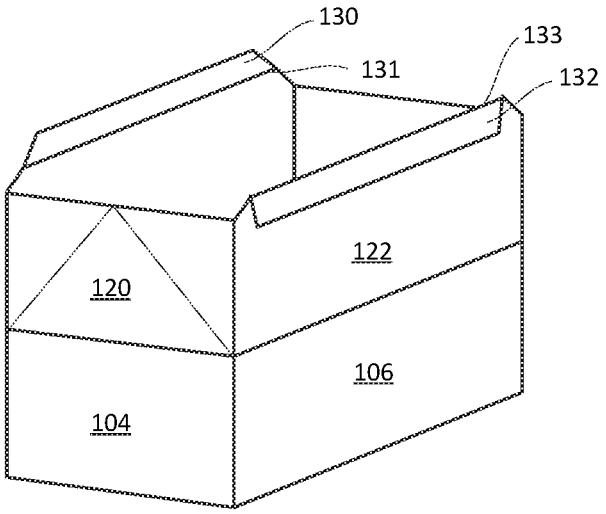
FIG. 2 is a perspective view of the paperboard food container with the closure in an open position.
Figure 3:
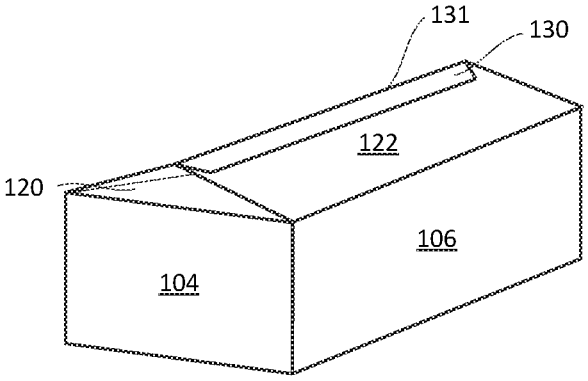
FIG. 3 is a perspective view of the paperboard food container with the closure in a closed position and sealed.

Starting with the section 122, the section 122 has edge 133 with a length, and the tab 132 is attached to the edge 133. The tab 132 has a first position wherein the tab 132 overlies a portion 136 of the first surface having a length substantially equal to the length of the edge 133. See FIG. 2. The tab 132 also has a second position wherein the tab 132 is spaced from the first surface, such as is the case in the blank 100 of FIG. 1, or the assembled, or formed, container of FIG. 3.

One of the tab 132 and the portion 136 of the first surface has an adhesive disposed thereon. The other of the tab 132 and the portion 136 of the first surface has a release coating disposed thereon. As illustrated in the embodiment of FIG. 1, the tab 132 has the release coating disposed thereon, while the portion 136 has the adhesive disposed thereon. According to other embodiments, the situation may be reversed.

The adhesive may be a pressure-sensitive adhesive, such as the PRIMELT 3017 pressure-sensitive, hot melt adhesive manufactured and sold by Prime Blend of Wayne, Pennsylvania. Further, the release coating may be a silicone release coating, such as the SUNSYS VALLOGO V011 silicone release coating manufactured and sold by Sun Chemical of Parsippany, NJ.

With the tab 132 in the first position (see FIG. 2), the portion 136 of the first surface having the adhesive disposed thereon cannot be joined to the second surface (e.g., tab 130) to seal the closure. With the tab 132 in the second position (see FIG. 1), the portion 136 of the first surface having the adhesive disposed thereon is joined to the second surface (e.g., tab 130) to seal the closure (see FIG. 3).

According to the disclosed embodiments, one of the first and second surfaces has a tamper-evident region of weakness that may be irreversibly split to open the closure. According to the illustrated embodiment, the second surface has a tamper-evident region of weakness formed by a series of perforations disposed along the edge 131 that joins the tab 130 to the section 118. In the alternative, the tamper-evident region of weakness could have been formed by two parallel sets of perforations arranged along the edge 131, the perforations defining a tear strip therebetween.

As illustrated, the portion 136 of the first surface has a length that may be at least 85% of the length of the edge 133, measured at its longest dimension (i.e., measured at the longest dimension of the portion 136). In fact, the portion 136 of the first surface has a length that may be at least 90% of the length of the edge measured at its longest dimension. According to some embodiments, the portion 136 may have a length that is at least 75%, or a length that is at least 95%, 99% or 100% of the edge 133.

As is also illustrated, the length of the edge 131 of the second surface is equal to the length of the edge 133 of the first surface, and the tab 130 of the second surface has a length that is substantially equal to the length (e.g., 95%, 97%, 98%, 99% or 100% of the length) of the edge 131 of the second surface. The length of the tab 130 of the second surface may be at least 85% of the length of the edge 131 of the second surface measured at its longest dimension. In fact, the length of the tab 130 may be at least 90% of the edge 131 of the second surface. According to some embodiments, the tab 130 may have a length that is at least 75%, or a length that is at least 95%, 99% or 100% of the edge 131.

According to the exemplary embodiment, the paperboard container, as assembled, takes the shape of a rectangular box, and in particular a rectangular box with a gabled closure. It will be recognized that according to other embodiments, a container having a greater number (or a lesser number) of sides may be formed, as assembled. Further, the illustrated paperboard container is designed to lie flat in a storage state, with the tab 132 of the first surface disposed in the first position. It will be recognized that according to other embodiments, the container may not lie flat in a storage state.

It is believed that the paperboard container just described may have several benefits, one or more of which may be present in an embodiment according to the present disclosure. By providing a container made of paperboard, the container may be designed to be substantially (e.g., 75%, 85%, 90%, 95%, 100%) biodegradable, limiting disposal issues. By providing a container with a tamper-evident closure, it may be determined if the container has been opened after the food product is disposed in the container and the closure sealed. Further, by providing the structure that conceals the adhesive used to seal the closure using a joined section of the container, the waste issues caused by providing, for example, a separate strip of material with a release coating applied thereto may be avoided. At the same time, the simplicity of the use of the fold-over tab to conceal the adhesive aids the adoption of the container by end users.

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

What is claimed is:

1. A paperboard container comprising:

a paperboard receptacle enclosing in an assembled state an interior three-dimensional space configured to receive a food product and having an opening through which the food product enters the space; and a paperboard closure disposed across the opening, the closure comprising first and second surfaces, the first surface attached to the receptacle along a first surface fold line and the second surface attached to the receptacle along a second surface fold line, the first surface having a first surface edge opposite the first surface fold line, the first surface edge with a length and a first surface tab attached to and projecting from the first surface edge, and the second surface having a second surface edge opposite the second surface fold line, the second surface edge with a second surface tab attached to and projecting from the second surface edge;

the closure having a first state wherein the first surface tab is in a first position with the first surface tab overlying a portion of the first surface having a length substantially equal to the length of the first surface edge and the closure having a second state wherein the first surface tab is in a second position with the first surface tab spaced from the first surface, the portion of the first surface having an adhesive disposed thereon and the first surface tab having a release coating disposed thereon, wherein with the first surface tab in the first position, the portion of the first surface having the adhesive disposed thereon cannot be joined to the second surface to seal the closure, and wherein with the first surface tab in the second position, the portion of the first surface having the adhesive disposed thereon is joined to the second surface tab to seal the closure with the first surface edge aligned with the second surface edge and the second surface is disposed exterior relative to the first surface tab which is disposed interior relative to the second surface, one of the first and second surfaces having a tamper-evident region of weakness that may be irreversibly split to open the closure.

2. The paperboard container of claim 1, wherein the portion of the first surface has a length that is at least 90% of the length of the first surface edge measured at its longest dimension.

3. The paperboard container of claim 1, wherein the portion of the first surface has a length that is at least 85% of the length of the first surface edge measured at its longest dimension.

4. The paperboard container of claim 1, wherein the first portion has a pressure-sensitive adhesive disposed thereon and the first surface tab has a silicone release coating disposed thereon.

5. The paperboard container of claim 1, wherein the region of weakness is disposed along the second surface edge.

6. The paperboard container of claim 5, wherein the length of the second surface edge is equal to the length of the first surface edge, and the second surface tab has a length that is substantially equal to the length of the second surface edge.

7. The paperboard container of claim 6, wherein the length of the second surface tab is at least 90% of the length of the second surface edge measured at its longest dimension.

8. The paperboard container of claim 6, wherein the length of the second surface tab is at least 85% of the length of the second surface edge measured at its longest dimension.

9. The paperboard container of claim 5, wherein the region of weakness is a line of perforations.

10. The paperboard container of claim 5, wherein the region of weakness is a tear strip.

11. The paperboard container of claim 5, wherein the paperboard closure is a gabled closure with an apex along the aligned first and second surface edges.

12. The paperboard container of claim 11, wherein the paperboard closure comprises third and fourth sections, the third and fourth sections joined between the first and second sections.

13. The paperboard container of claim 1, wherein the paperboard container comprises a rectangular box.

14. The paperboard container of claim 1, wherein the paperboard container lies flat in a storage state, with the tab of the first surface disposed in the first position.

15. The paperboard container of claim 1, wherein the first surface tab is unattached to the second surface with the first surface edge aligned with the second surface edge and the second surface is disposed exterior relative to the first surface tab which is disposed interior relative to the second surface.

* * * * *